United States Patent [19]

Metz

[11] Patent Number: 4,604,516

[45] Date of Patent: Aug. 5, 1986

[54] CASCADED ARRANGEMENT FOR ELECTRICALLY HEATING FLUIDS TO HIGH TEMPERATURE

[75] Inventor: Bruce E. Metz, Wilmington, Del.

[73] Assignee: Athena Controls Inc., Plymouth Meeting, Pa.

[21] Appl. No.: 515,161

[22] Filed: Jul. 19, 1983

[51] Int. Cl.[4] ..... H05B 1/02; F24H 1/10; F24H 3/04

[52] U.S. Cl. ..... 219/379; 219/307; 219/308; 219/331; 219/364; 219/499; 219/501; 219/504

[58] Field of Search ..... 219/381, 328, 374–376, 219/364, 306–309, 373, 501, 504, 505, 499, 379, 380, 331

[56] References Cited

U.S. PATENT DOCUMENTS

| | | | |
|---|---|---|---|
| 1,261,086 | 4/1918 | Wilson et al. | 219/504 |
| 2,367,170 | 1/1945 | Fahrenwald | 219/362 X |
| 2,838,643 | 6/1958 | Elliot et al. | 219/364 X |
| 2,896,056 | 7/1959 | Borrup et al. | 219/364 X |
| 3,344,257 | 9/1967 | Moeller | 219/381 X |
| 3,551,643 | 12/1970 | Pricenski et al. | 219/307 X |
| 3,679,871 | 7/1972 | Evalds | 219/501 X |
| 3,737,622 | 6/1973 | Hallgreen | 219/379 X |
| 3,783,236 | 1/1974 | Edin | 219/307 X |

*Primary Examiner*—A. Bartis

*Attorney, Agent, or Firm*—William E. Cleaver

[57] ABSTRACT

A cascaded fluid heating for electrically heating to fluid, such as a gaseous fluid in a flameless torch, to a high temperature includes a pump to pump a relative constant stream of fluid through a pair of heating chambers arranged in series. A first electric heating element formed of a nickel-iron alloy having a substantially linear positive temperature coefficient of resistance up to 1100° F. is disposed in the first chamber and heats the fluid stream to a first temperature. A second heating chamber receives the heated fluid from the first chamber and contains a second electric heating element of a material, such as Kanthal A, which does not oxide at temperature up to 2000° F. for heating the fluid to a higher temperature. The first electric heating element acts as a sensor for a temperature controller for the first heating element whereby the current supplied by the controller to the first heating element responsive to the changes in resistance of thereof. Interface circuitry connected to the power supply circuit of the first heating element is provided for supplying electric current to the second heating element in direct response with the amount of electric current delivered to the first heating element by the temperature controller. The second heating element is thus connected to "track" the first heating element and is not subjected to high current densities should the fluid flow be reduced drastically or stopped.

7 Claims, 3 Drawing Figures

CASCADED ARRANGEMENT FOR ELECTRICALLY HEATING FLUIDS TO HIGH TEMPERATURE

BACKGROUND

The present invention is directed to devices which provide streams of high temperature gaseous fluid, such as air, or high temperature fluids to systems or items which require the same. For instance, flameless torches are used to solder items, to dry items such as coatings and ink, cure epoxy resin, shrink heat shrinkable film, sterilize air or nitrogen for use in packaging medical products, and the like. Hot fluids are pumped through hoses to cause viscous fluids to flow more easily.

By way of example the present invention is described in connection with a flameless torch, but other devices fit within the invention such as heated hoses and the like. In the past, such flameless torches have been restricted in how high the temperature of the gas might go because of the length of the torch, materials limitations, and because of the high watt density. The foregoing occurs because the flameless torch of the prior art uses a single heating element. In addition, there are failures in the prior art systems because the heating elements burn out, if the gas flow becomes sufficiently reduced or stopped.

The present system has overcome these infirmities because it has a two stage heating arrangement connected to a fast response temperature controller. Large amounts of heat are added to the fluid in the second stage. The present system prevents failures, i.e. burning out the heating elements by having the first stage heater act as a sensor. The electrical current flowing through the first stage heater is in proportional relationship to its resistance. If the gas flow were to stop and the heat rise, the electrical current would be reduced accordingly and such would not result in a burned out element. The second stage heater is connected to "track" the first stage heater so that the second stage heater is not subjected to high current densities if the gas flow is reduced drastically or stopped.

The objects and features of the present invention will be better understood in view of the following description taken in conjunction with the drawings wherein.

Figure 1:
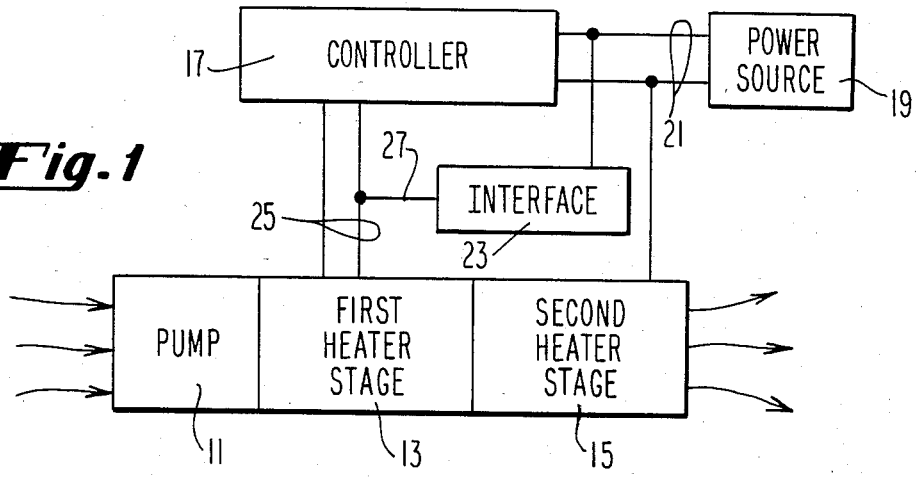
FIG. 1 is a block design layout of the present invention.

Consider FIG. 1. In FIG. 1 there is shown a pump 11 which brings in air, or some other fluid, and discharges, or forces it, through the first heating stage 13 and second heating stage 15. The pump 11 can be any one of a number of pumps and in the preferred embodiment is a GAST oiless model manufactured by the GAST Company. The shell of the first and second heater stages are formed of quartz lined stainless steel manufactured by GTE/SYLVANIA, in the preferred embodiment. It should be understood that other forms of material such as plain quartz tubing could be used. Within the first heating stage 13 there is disposed a heating element which is connected to the temperature controller 17. In the preferred embodiment the temperature controller 17 is an Athena Series 68, manufactured by the Athena Corporation.

In accordance with the teaching of U.S. Pat. No. 3,679,871 and in accordance with the operation of the Athena Series 68, the electrical resistance element connected to the controller 17 acts as a sensor for the electrical current output of the controller 17. In other words, the heating element of the first heater stage is made of material whose positive temperature coefficient of resistance is substantially linear up to 1100° F. As the element heats up its resistance changes. The element is part of a bridge circuit so that as its resistance changes, the error signal from the bridge circuit changes. The error signal is used as a control signal to provide more or less electrical current as the resistance of the heating element of the first stage changes. In short the controller "sees" temperature as resistance.

The heating element of the first stage is fabricated from an alloy which is made up of 70% nickel and 30% iron, in the preferred embodiment. Such an alloy has a linear positive temperature coefficient up to 1100° F. However above 1100° F. the temperature coefficient is not linear and the material oxidizes. Accordingly, the system employs a second heater stage which has a heating element made of material which can generate very high temperatures and which will not oxidize at the high temperatures. In the preferred embodiment, the heating element of the second heating stage is made from Kanthal A, a product of the Kanthal Corporation. Such a material is an alloy of nickel, chromium and aluminum. After the first heater stage has heated the air or the fluid to 900° F. or less, the gaseous fluid is sent into the second heating stage 15 whereat it can be heated in excess of 1800° F.

As can be gleaned from FIG. 1 electrical power is passed from the power source 19 to the controller 17 along the lines 21. Power is also transmitted from the lines 21 to the second heating stage 15 under control of the interface circuit 23. The controller 17 passes power to the heater of the first heater stage via the lines 25 and the power from the controller provides a tracking signal on line 27 to the interface circuit 23.

Figure 2:
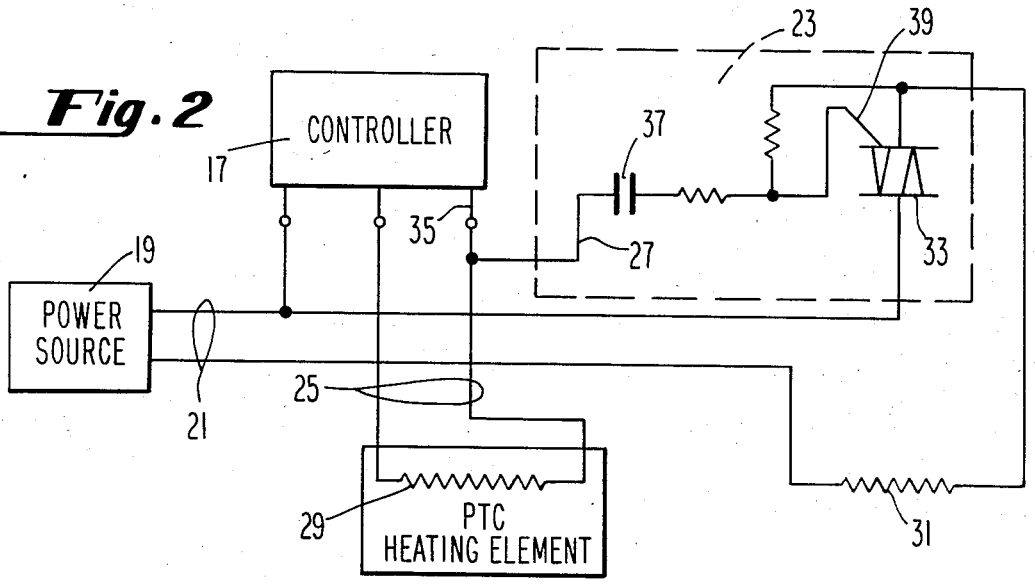
FIG. 2 is a schematic wiring diagram of one circuit used in the present invention.

The operation can be better understood by examining FIG. 2. In FIG. 2 the power source 19 and the controller 17 are shown. Power is applied to the controller 17 to cause the controller 17 to operate. As can be gleaned from the circuit of U.S. Pat. No. 3,679,871, the heating element of the first heating stage is part of a bridge circuit in the controller 17. The heating element 29, as explained above, varies in resistance as it generates heat and hence the amount of electrical current fed to the heating element 29, from the controller 17, varies in accordance with the temperature of the heating element and the setting of the controller. The way in which the controller varies the electrical current is to change the time in the cycle that a switching element (such as a silicon controlled rectifier) is turned on. The earlier in the cycle that the switch is turned on, the more the amount of electrical current that is passed through the resistor 29. The tracking operation of the second heating element 31 makes use of the signal timing concept.

As can be seen in FIG. 2 there is a triac 33, connected through the second heating element 31, across the power lines 21. The controller 17 provides pulsed signals on line 35. A pulsed signal is transmitted through the capacitor 37 to the gate element 39 to turn on the triac 33. If the pulsed signal is provided early in the cycle, a relatively large amount of electrical current is transmitted to the heating element 31. On the other hand if the pulsed signal is provided late in the cycle, a reduced amount of electrical current is passed through the heating element 31. Since the controller 17 regulates the amount of electrical current to the heating element 29 in response to its temperature by providing pulsed signals in commensurate parts of the cycles, then the controller likewise regulates the electrical power to the heating element 31. In short, the electrical current to the heating element 31 tracks the electrical current to the heating element 29.

Figure 3:
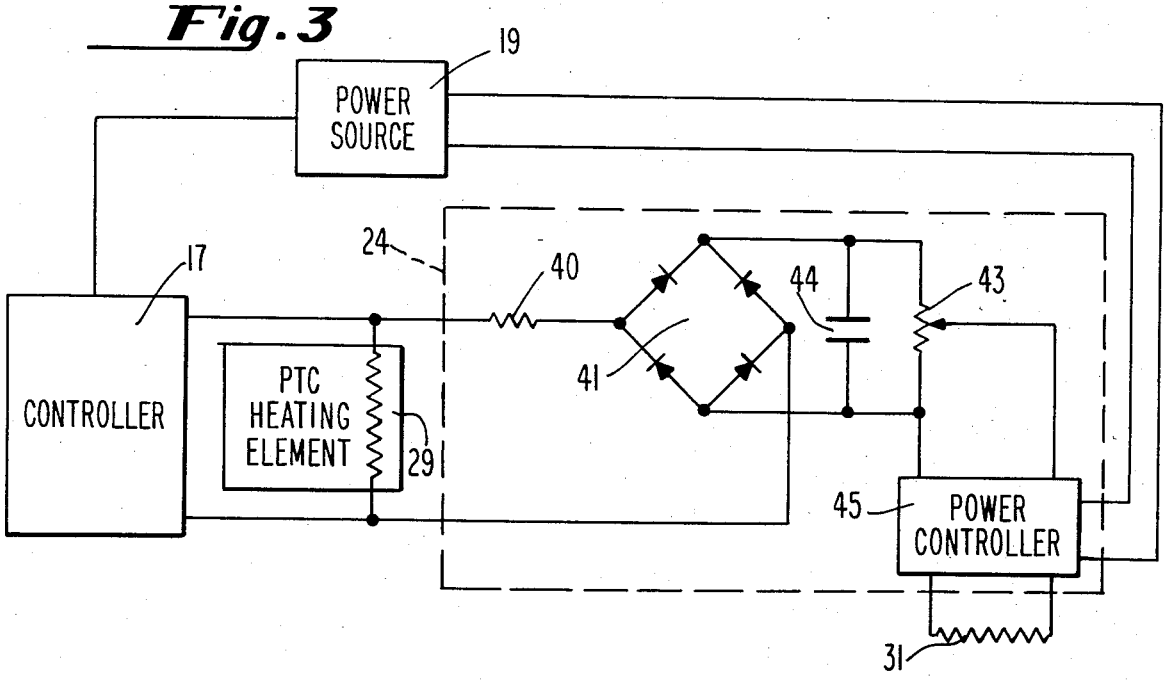
FIG. 3 is a schematic wiring diagram of a second circuit used in the present invention.

FIG. 3 depicts another arrangement which permits the second heating stage to vary its heat output. As can be readily understood, the arrangement of FIG. 2 is fixed in the sense that if for some use, the user wanted more heat in the second stage than was available at a prior time, (while wanting a predetermined amount of heat from the first stage to remain the same), he could only accomplish this change by changing the heater 31 to another value of resistance. In FIG. 3 there is an interface circuit connected across the first heater 29. The power signals passed through the heater 29 are also passed to the full wave rectifier 41. The full wave rectifier 41 provides a direct current voltage across the potentiometer 43. The tap from the potentiometer 43 is connected to the power controller 45. The power controller 45, in the preferred embodiment is an Athena 91P power controller, manufactured by Athena Corporation. Other forms of power controllers can be used. The power controller 45 provides power pulses to the second stage heater 31. It is apparent that if the potentiometer 43 is set at another position a different amount of power will be delivered to the second heater 31. Hence the user can provide a different amount of heat in the second stage than he may have used at a prior time while maintaining the same heat in the first stage.

As mentioned above, the present invention has been described by describing a flameless torch. The present invention can be usefully employed to heat other forms of fluid such as oils or water or fluids used in heated hoses. Such uses are within the invention concept.

I claim:

1. A cascaded fluid heating arrangement comprising in combination: pump means formed to discharge a relatively constant stream of fluid; electrical power source means; temperature controller means connected to said electrical power source means to receive electrical energy therefrom; first electrical heating means connected through first connecting circuitry to said temperature controller means, said first electrical heating means disposed in a first heating chamber means which is coupled to said pump means to receive said relatively constant stream of fluid therefrom to enable said first electrical heating means to heat said stream of fluid to a first temperature, said first electrical heating means formed and disposed to act as a sensor whereby said temperature controller includes means responsive to changes in electrical resistance in said first electrical heating means; second electrical heating means disposed in a second heating chamber, which second heating chamber is coupled to said first heating chamber to receive said stream of fluid therefrom and whereby second electrical heating means heats said stream of fluid to a higher temperature than said first temperature; interface circuitry means connected to said first connecting circuitry and disposed to connect said power source to said second electrical heating means, said interface circuitry formed such that as the electrical current to said first electrical heating means varies, said interface circuitry will cause said power source to provide a related variation in current directly to said second heating means.

2. A cascaded fluid heating arrangement according to claim 1 wherein said first electrical heating means has a substantially linear positive temperature coefficient of resistance up to 1100° F.

3. A cascaded fluid heating arrangement according to claim 1 wherein said second electrical heating means is formed of material which does not oxidize up to temperatures of 2000° F.

4. A cascaded fluid heating arrangement according to claim 1 wherein said first electrical heating means is fabricated from an alloy of 70% nickel and 30% iron and said second electrical heating means is fabricated from Kanthal A material.

5. A cascaded fluid heating arrangement according to claim 1 wherein said interface circuitry means includes a triac which is connected to deliver electrical current from said electrical power source means directly to said second electrical heating means in accordance with the amount of electrical current delivered to said first electrical heating means.

6. A cascaded fluid heating arrangement according to claim 1 wherein said interface circuitry means is formed to develop a direct current signal which is proportional to the electrical current flow in said first electrical heating means and wherein said interface circuitry means includes a power controller means, which in response to said direct current signal provides electrical current from said electrical power source means, independent of said first electrical heating means, to said second electrical heating means whereby the electrical current in said second electrical heating means may have a different value of amps than the electrical current in said first electrical heating means.

7. A cascaded fluid heating arrangement according to claim 6 wherein said interface circuitry means includes means to vary said direct current signal to change the amount of heat generated by said second electrical heating means.

* * * * *